United States Patent [10]

Bogner et al.

[11] 4,054,877

[45] Oct. 18, 1977

[54] CIRCULARLY POLARIZED DIPOLE TYPE OMNIDIRECTIONAL TRANSMITTING ANTENNA

[76] Inventors: Richard D. Bogner, 4 Hunters Lane, Roslyn, N.Y. 11576; Leonard H. King, 67 Southgate Road, Valley Stream, N.Y. 11581

[21] Appl. No.: 661,975

[22] Filed: Feb. 27, 1976

[51] Int. Cl.[2] ..... H01Q 9/16

[52] U.S. Cl. ..... 343/806; 343/821

[58] Field of Search ..... 343/726, 727, 730, 744, 343/770, 771, 816, 806, 821

[56] References Cited

U.S. PATENT DOCUMENTS

| | | | |
|---|---|---|---|
| 2,465,245 | 3/1949 | Mabry | 343/821 |
| 2,480,182 | 8/1949 | Clapp | 343/798 |
| 2,512,137 | 6/1950 | Buchwalter et al. | 343/892 |
| 2,611,867 | 9/1952 | Alford | 343/770 |
| 3,340,534 | 9/1967 | Fee | 343/771 |
| 3,975,733 | 8/1976 | Bogner | 343/770 |

*Primary Examiner*—Eli Lieberman

*Attorney, Agent, or Firm*—Bauer, Amer & King

[57] ABSTRACT

An omnidirectional broad band antenna employs a slot and a pair of radiating arms excited by the slot. In one embodiment slots are formed in a coaxial transmission line and covered by a resin bonded glass fiber layer which serves as an integral radome and permits pressurization. The arms are of substantial girth and one arcs upwardly and circularly and the other arcs downwardly and circularly thus providing a large spacing between arms. The antenna is characterized by a broad bandwidth and low VSWR.

1 Claim, 8 Drawing Figures

FIG. 1
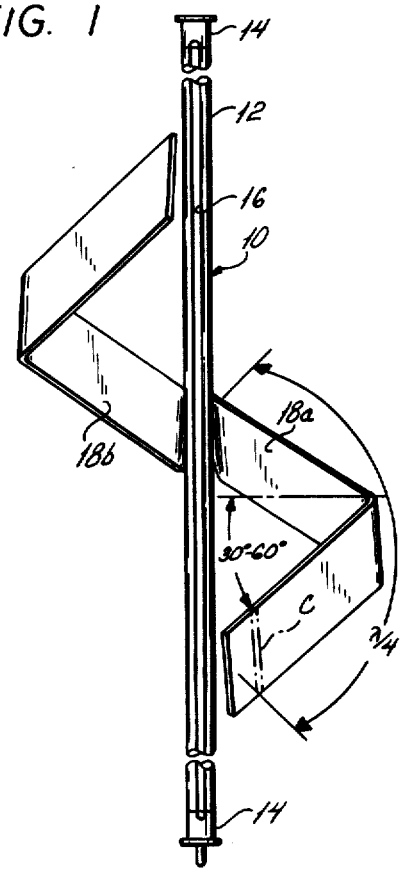
FIG. 2
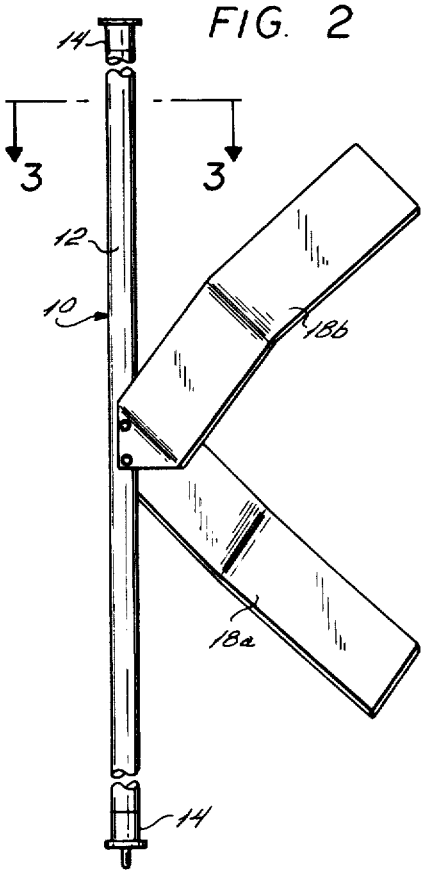
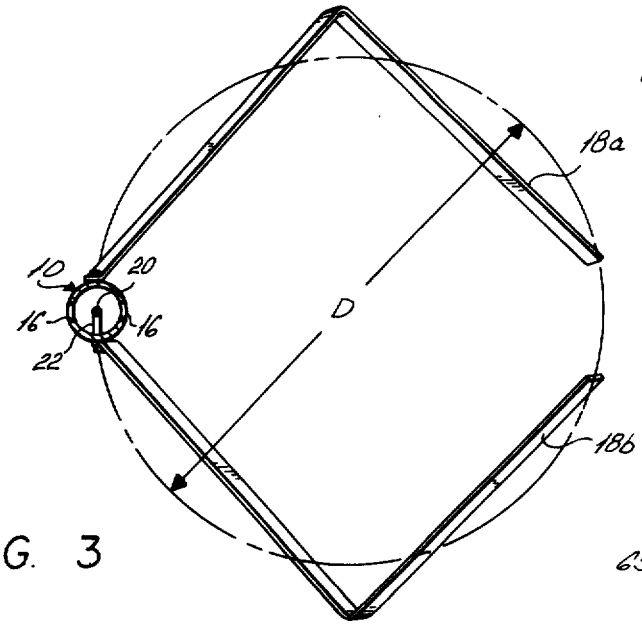
FIG. 3
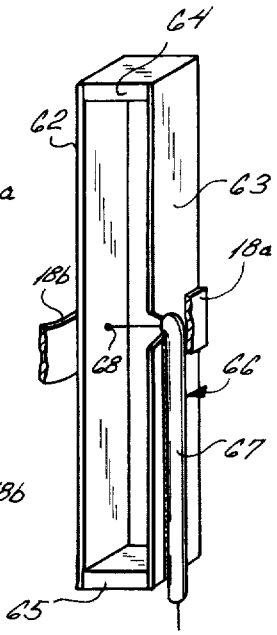
FIG. 8

CIRCULARLY POLARIZED DIPOLE TYPE OMNIDIRECTIONAL TRANSMITTING ANTENNA

BACKGROUND OF THE INVENTION

Omnidirectional circularly polarized broadcast antennas for stations operating in the FM band are often of the type described in previous U.S. Pat. No. 3,474,452 of Richard D. Bogner, one of the applicants herein. That is, each bay consists of thin arms (less than 1/20 wavelength in girth for at least a substantial part of their length) extending away from a vertical coaxial transmission line, and are excited from the line by one (or more) thin metal straps connected between the line center conductor and one arm. These designs have the characteristics of being narrow band i.e. the impedance varies rapidly with frequency such that the VSWR is often under 1.1 over only 50 to 100 KHz, whereas the station transmits a 200 KHz band. The antennas are critical with regard to the region of the strap and the small opening in the vertical coaxial line, such that dirt, ice, humidity, very small mechanical movements tend to detune the antenna. This prior art construction frequently requires the use of fine tuners, radomes, deicers and frequently require repair or readjustment. The excitation straps and the narrow spacing also makes possible voltage breakdown in that area of the antenna.

BRIEF SUMMARY OF THE INVENTION

It has been found that these undesirable characteristics can be eliminated, while maintaining or improving the generally desirable radiation pattern and axial ratio characteristics of this antenna type. This is achieved by employing slot excitation and "fat" arms having a girth of at least 0.1λ or more throughout substantially their entire length of about λ/4 each. Thus there is eliminated the small opening in the coaxial outer conductor and the strap connected through it (to the center conductor on one end, and to a point on one arm on the other end). Arm excitation is achieved by providing a long slot on both sides of the support tube, the slot extending about λ/4 on each side of the feed point, the width of the band having a VSWR under 1.1 can be increased to as much as 1 MHz, the pattern made perfectly symmetrical, and effects of dirt, ice, power, humidity, tolerances and movement made negligible so that no additional radome, deicer, or tuner is needed. It is, in general, desirable for structural reasons due to the thin support tube wall often employed and also to allow line pressurization, to cover the slots with an electrically non-conductive but strong material, such as resin impregnated glass fibers. The arms may be e.g. plates or tubes and, in general, thrust or spiral outwardly and upwardly on one side and out in the same direction and downwardly on the other side of the slot. Means for making final adjustments of the antenna without violating the seal is provided.

The above description, as well as further objects, features and advantages of the present invention, will be more fully appreciated by reference to the following detailed description of a presently preferred, but nontheless illustrative embodiment in accordance with the present invention when taken in conjunction with the accompanying drawings wherein:

IN THE DRAWINGS

FIG. 1 is a front elevational view of a single bay antenna of this invention;

FIG. 2 is a side elevational view thereof;

FIG. 3 is a sectional view taken along line 3—3 of FIG. 2;

FIG. 8 is a pictorial view of a slot formed of flat sections with the dipole arms shown broken away for purposes of clarity.

DESCRIPTION OF THE PREFERRED EMBODIMENT

Figure 4:
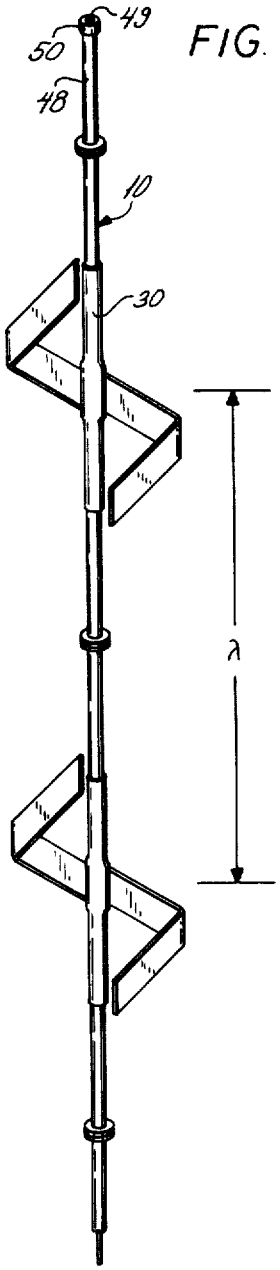
FIG. 4 is a front elevational view of a three bay antenna array.

The antenna of this invention has been found particularly suitable for the FM broadcast band. At the present time in the United States this band extends from 88 to 108 megahertz. Each station is assigned a channel having a bandwidth of 200 kilohertz and the term lamda (λ) refers to a frequency at the center of the assigned channel. It is important that an antenna maintain a voltage standing wave ratio (VSWR) over the 200 KHz operating band within assigned channel of less than 1.1.

The present invention makes use of the standard transmission line commonly used in the broadcast industry. Such lines are available in sizes having an outside diameter of 1⅝, 3⅛ and 6⅛ inches. The standard lines are provided with an impedance characteristic of 50 ohms.

Referring now to FIG. 1 wherein there is shown a typical single bay antenna of this invention, indicated generally by the numeral 10. The transmission line 12 is generally a hard copper tube with a smaller diameter copper tube as the centrally located inner conductor. The transmission line is terminated at its end with a standard flange member 14 for connection to additional bays or to a transmission line. Slots 16 are formed in the wall of the transmission line, having a length of approximately λ/2. The slots extend through diametrically opposite sides of the transmission line and the opposed slots 16 are shown in FIG. 3. Near the center points of the walls between the slots there are affixed a pair of arms that generally spiral about a cylinder of a diameter D. D is approximately the diameter of a circle inscribed and circumscribed by arms having right angle λ/8 portions. The cylinder may be considered as approximately tangent to the vertical section of transmission line 12. The arms are each of a length approximately λ/4. It will be noted that arm 18A spirals downwardly at an angle of between 30° and 60°, while arm 18B spirals upwardly at the same angle.

In order to excite the arms, the center conductor 20 of the coaxial line is connected internally to one wall of the coaxial line by means of a jumper 32. Typically, the slot would be about ½ inch wide for a 1⅝ inches line, 1 inch wide for a 3⅛ inches line and 1½ inches wide for a 6⅛ inches line.

It has been found that the girth "C" of the arm has a bearing on the resultant bandwidth. A larger girth producing a wider bandwidth than prior art thin arms and accordingly the girth should be not less than about 0.1λ.

Figure 5:
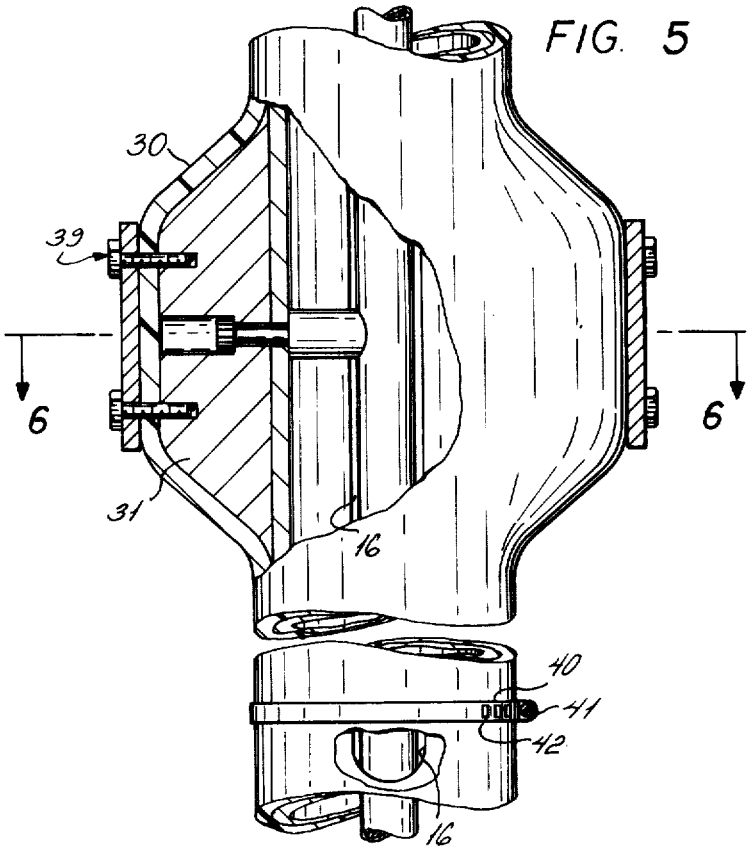
FIG. 5 is a partially broken away front elevational view of a section of a single element with a section.
Figure 6:
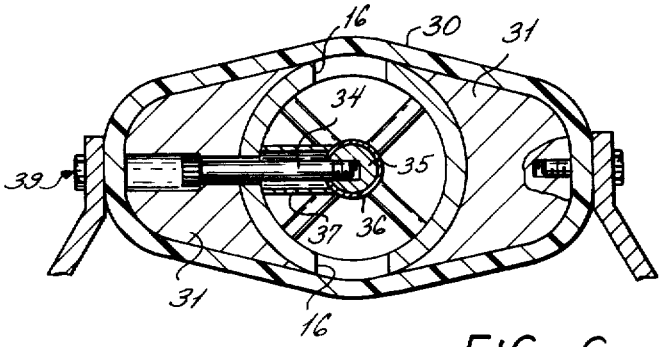
FIG. 6 is a partially broken away sectional view taken along line 5—5.
Figure 7:
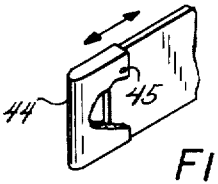
FIG. 7 is a pictorial view of a section of an arm with an adjustment cap shown partially broken away.

It is, in general, desirable for structural reasons due to the weakening of the coaxial line wall by the slots and in order to allow line pressurization, to cover the slot with an electrically non-conductive sealing material. A construction that satisfies these requirements is shown in FIGS. 4, 5 and 6. In FIG. 4 there is shown a typical three bay array of the elements, with the individual bays being joined together with a spacing of one wavelength being maintained between the center points of the arms.

In order to provide added structural support for the arms, a pair of metal blocks contoured to the shape of the coaxial tube may be fixed to the walls of the tube by brazing or whatever suitable method which will provide mechanical strength and electrical conductivity. The blocks need only be long enough to support the arms.

Metal block 31 has a hole bored through leading to the interior of the coaxial line. Bolt 34 engages a threaded bore in a metal plug member 35 within the center conductor 36 of the coaxial line. A short tube 37 serves as a spacer. As bolt 34 is tightened into the bore 35, the center conductor spacer is drawn up against member 37 and is secured therein. The bolt may then be solder sealed to the metal block.

The structure is then covered with resin impregnated fiberglass cloth 30 or fiberglass matting or may even be filament wound. A layer of glass resin of approximately ⅛ inch has been found suitable to provide the mechanical strength and sealing to permit pressurization of the line. The resin may be by way of example polyesters or epoxy resins. Such materials are commonly used in the aircraft, boat and reinforced fiberglass industry.

After the wrapping is complete and the resin hardened, holes are drilled through the fiberglass 30 and into the block. The faces of the fiberglass 30 against which arms 18A and 18B are secured are then machined square. The arms may then be attached by means of bolts 39.

The arms may be flat members as shown or tubes that, in general, thrust and spiral outward and upward on one side and out in the same direction and downward on the other. It has been found convenient to fabricate the arms employing flat plates with right angle bends, however, the arms may be arcuate or otherwise shaped to fit within the above-recited parameters.

Conventional support brackets (not shown) are used to affix the bays to a supporting tower. Such supports are commercially available from a number of sources and form no part of the present invention. If metal, such supports must not make electrical contact between the line and the tower in the region of the slots, but only above and below the slots.

In order to provide for simple external impedance matching, the slot 16 is intentinoally made approximately 1 inch longer than the optimum λ/2 length. Matching is then achieved by moving a metal band 40 longitudinally to and fro along the slot until the VSWR is within the desired value. The VSWR may be readily measured by means of a Smith Chart plotter. The metal band 40 may be a conventional stainless steel hose clamp equipped with a locking worm 41 engaging slots 42. The band capacitively couples to the transmission line to short out the undesired portion of the slot.

It is also desirable to provide means to slightly vary the length of the dipole arms to achieve optimum matching. For this purpose, a metal end cap 44 is slidingly mounted on the end of the arm. When the desired match is obtained, a pin 45 is driven in to a drilled hole to lock the cap in place.

The coaxial line is terminated by a λ/4 section of line 48 shorted at the end by a bolt 49 extending through an end cap 50 and contacting the center conductor.

An antenna constructed in accordance with the foregoing was characterized by a horizontal plane pattern which was omnidirectional within ±1½ db for all polarizations and the axial ratio was better than 3 db in any azimuth including the effect of the coaxial feed line. The VSWR was under 1.1 over a band of approximately 1 MHz (corresponding to five (5) FM channels). Surprisingly, a VSWR of under 1.1 was maintained over the design channel without the necessity of employing a fine tuner and even when mounted down to only about 12 inches from the corner of a 120 inches wide triangular tower.

It is preferred to employ a spacing of λ between the dipole feed points, however, other spacings may be employed. For example, by alternating the feed direction from the center conductor to the side wall of successive bays the optimum spacing would be λ/2. If fed by a coaxial line, other spacings may be employed with consideration being given to the effects of spacing on the coupling between bays.

The bays of an array may be fed by the continuous coaxial line as shown in FIG. 4 or may be individually fed by conventional coaxial feed lines from a power divider connected to the transmitter.

In an alternative embodiment shown in FIG. 8, the slots 60 may be simply formed by utilizing a pair of parallel spaced plates 62 and 63 joined together electrically by shorting bars 64 and 65 spaced about λ apart. Coaxial line 66 has its outer conductor 67 bonded to plate 63 and its inner conductor 68 passes through plate 63 and is joined to plate 62. The coaxial line joins the slot at approximately the midpoint thereof.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A transmitting antenna for radiation of signals of wavelength λ comprising:

a. a coaxial transmission line consisting of an elongated metal tube serving as an outer conductor and a coaxial conductive member coextensive therewith serving as a center conductor, said tube having two side wall portions isolated each from the other by a pair of diametrically opposed slots, each of a length of about λ/2;

b. an electrically conductive member joining the said center conductor to one of said side wall portions; a first conductive arm electrically connected to one said side wall portion at approximately the midpoint of the slot and having a length of about λ/4 extending at an angle of from 30° to 60° downward relative to the axis of the said outer conductor said arm extending generally outwardly in an arc from said first side wall; and a second conductive arm electrically connected to the other side wall portion at approximately the midpoint of the slot and having a length of about λ/4 extending at an angle of from 30° to 60° upward relative to the axis;

c. a continuous resin bonded electrically non-conductive fiber cover surrounding the said outer conductor; and d. a metal band surrounding said cover and capacitively coupled to the said side walls.

* * * * *